United States Patent [19]

Kajimoto et al.

[11] 4,043,262

[45] Aug. 23, 1977

[54] APPARATUS FOR IMPRINTING MARKINGS ON CYLINDRICAL VESSELS FOR COMPRESSED GASES OR THE LIKE

[75] Inventors: Isamu Kajimoto, Amagasaki; Hideaki Morii, Gifu, both of Japan

[73] Assignees: Morii Chokoku Co., Ltd., Gifu; Sumikin-Kiko Co., Ltd., Amagasaki, both of Japan

[21] Appl. No.: 595,964

[22] Filed: July 14, 1975

[30] Foreign Application Priority Data

July 15, 1974 Japan ..... 49-80989

[51] Int. Cl.[2] ..... B44B 5/00; B41F 17/18

[52] U.S. Cl. ..... 101/7; 101/38 R; 197/6.4

[58] Field of Search ..... 101/5, 6, 7, 35, 36, 101/37, 38 A, 38 R, 72, 74, 75, 76, 91; 197/6.4; 198/750, 773, 774, 776

[56] References Cited

U.S. PATENT DOCUMENTS

| | | | |
|---|---|---|---|
| 2,088,196 | 7/1937 | Friden | 101/38 A |
| 2,351,519 | 6/1944 | Jonsson | 101/5 |
| 2,796,828 | 6/1957 | Ritzerfeld et al. | 101/91 |
| 2,829,591 | 4/1958 | Rovan | 101/91 |
| 2,920,556 | 1/1960 | Medert et al. | 101/38 R |
| 3,163,106 | 12/1964 | Failor | 101/6 |
| 3,172,357 | 3/1965 | Rudolph et al. | 101/38 X |
| 3,191,526 | 6/1965 | Ross | 101/91 |
| 3,260,194 | 7/1966 | Karlin | 101/38 R |
| 3,355,008 | 11/1967 | MiLazzo | 198/774 X |
| 3,367,197 | 2/1968 | Tabor et al. | 198/750 X |
| 3,456,814 | 7/1969 | Bautz | 198/750 X |
| 3,662,876 | 5/1972 | Hollis | 198/774 X |
| 3,666,086 | 5/1972 | Brockmann | 198/774 |
| 3,811,522 | 5/1974 | Wolf et al. | 101/37 |
| 3,863,564 | 2/1975 | Higuchi | 101/35 |

OTHER PUBLICATIONS

Machinery and Production Engineering, Oct. 11, 1972, vol. 121, No. 3126.

*Primary Examiner*—Louis G. Mancene
*Assistant Examiner*—Paul J. Hirsch
*Attorney, Agent, or Firm*—Frank J. Jordan

[57] ABSTRACT

An apparatus capable of full-automatically imprinting several lines of indicia on the rounded head of each steel or like metal cylinder for a compressed gas. The apparatus includes a frame having loading and unloading platforms at its rearward and forward ends, respectively. The gas cylinders are transferred one by one from the loading to the unloading platform through successive notional marking lines extending transversely of the frame at constant spacings. A marking mechanism arranged in register with each marking line has an arcuate marking surface on which a line of indicia is formed in relief and which is to be forced into pressure contact with the gas cylinder rotatably supported on each marking line in horizontal disposition. The marking surface is then rotated in rolling contact with the gas cylinder to imprint the line of indicia thereon. Several lines of indicia can thus be marked on each gas cylinder as the same travels through the successive marking lines.

5 Claims, 6 Drawing Figures

APPARATUS FOR IMPRINTING MARKINGS ON CYLINDRICAL VESSELS FOR COMPRESSED GASES OR THE LIKE

BACKGROUND OF THE INVENTION

This invention relates to an apparatus for automatically imprinting markings on the so-called bombs, or steel or like metal cylinders for compressed gases, among other metal-made cylindrical articles.

As is well known, steel cylinders are widely used as containers for compressed gases such as those of oxygen, chlorine, hydrogen, and carbon dioxide. Such steel cylinders are required to be clearly engraved with markings giving such information as the contents, date of production, serial number, and name of the manufacturer. This marking operation has heretofore been the handiwork of highly skilled workmen, performed at the expense of substantial time and labor because the information must be stamped on rounded surfaces of hard material. Moreover, as an inevitable result of manual operation, the characters stamped tend to be of irregular arrangement and uneven depth.

SUMMARY OF THE INVENTION

It is an object of this invention to provide an apparatus for efficiently imprinting markings on articles such as the metal cylinders for compressed gases, such that the markings can be formed either in a single line or a plurality of lines on each article.

Another object of the invention is to provide a marking apparatus of the character described which is easy to automate to such an extent as to require supervision only by unskilled labor.

A further object of the invention is to provide a marking apparatus such that desired indicia can be imprinted on each article to an unvarying depth and in regular arrangement.

A still further object of the invention is to provide a marking apparatus such that, in case each article is to be marked with several lines of indicia, the respective lines can be simultaneously imprinted on different articles, so that an extremely high production rate is realized.

With these and other objects in view this invention provides a marking apparatus which, outlined in its simplest form, includes a frame having a loading platform at its rearward end and an unloading platform at its forward end. Work rest means is arranged on the frame intermediate the loading and unloading platforms to permit each article to rest horizontally thereon so as to be rotatable about its own axis. A work transfer mechanism conveys the successive articles from the loading platform onto the work rest means and thence onto the unloading platform. Also arranged on the frame is work holding means for releasably holding the article on the work rest means against displacement while permitting the article to rotate about its own axis. A marking mechanism over the frame includes an arcuate marking surface which has formed thereon a line of indicia to be imprinted. The marking mechanism is moved back and forth to bring its marking surface into and out of pressure contact with the article rotatably held on the work rest means, and the marking surface is further rotated in rolling contact with the article to imprint the line of indicia thereon.

Since the desired indicia are imprinted on the successive articles while the marking surface is in rolling contact therewith, there is practically no possibility of the work being damaged by application of any undue pressure or shock. The marking mechanism outlined above is intended for use where a single line of indicia is to be impressed on each article. It is also possible to mark each article with several lines of indicia, by incorporating several marking mechanisms in the apparatus, as embodied in the preferred form of the apparatus disclosed herein.

The features which are believed to be novel and characteristic of this invention are set forth in particular in the appended claims. The invention itself, however, both as to its organization and mode of operation, together with the additional objects and advantages thereof, will become apparent as the description proceeds, with reference had to the accompanying drawings in which like reference characters refer to like parts throughout the several views.

DESCRIPTION OF THE PREFERRED EMBODIMENT

Figure 1:
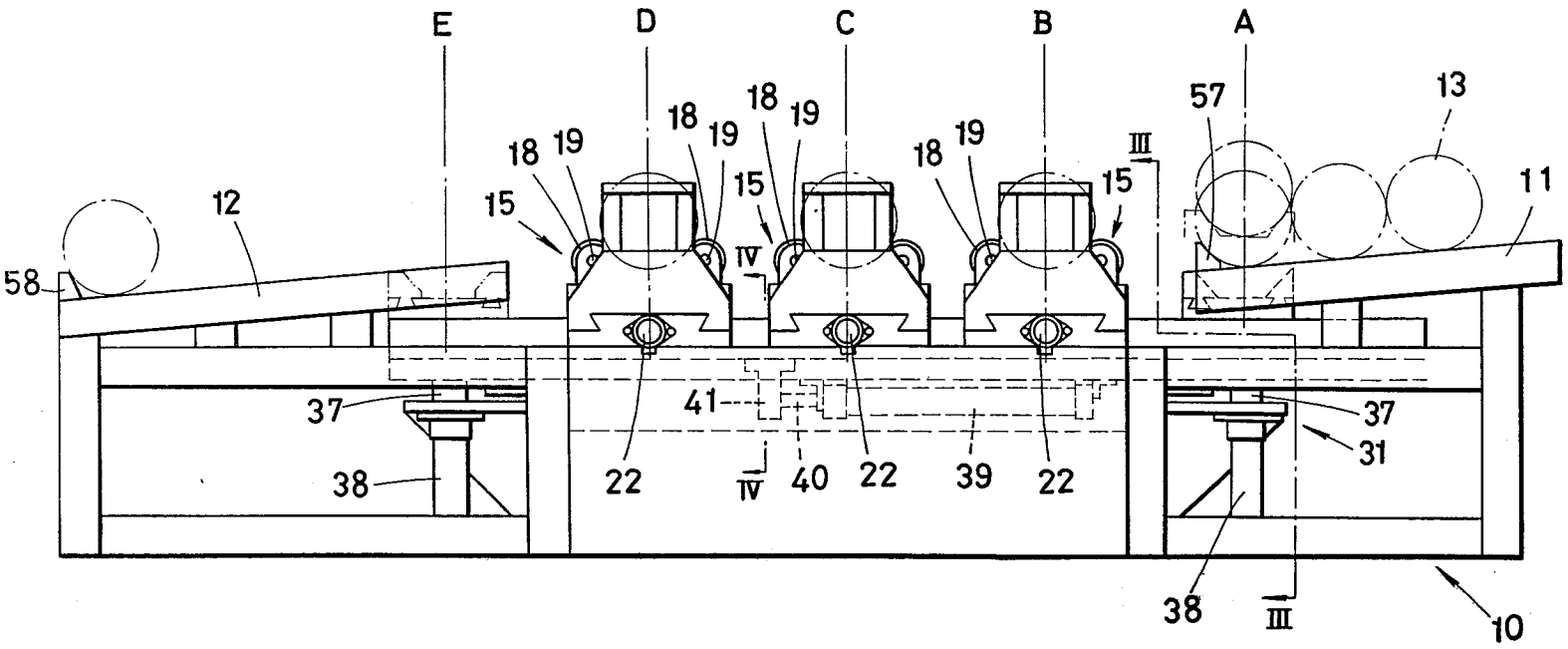
FIG. 1 is a side elevational view of the apparatus constructed in accordance with the novel concepts of this invention.
Figure 2:
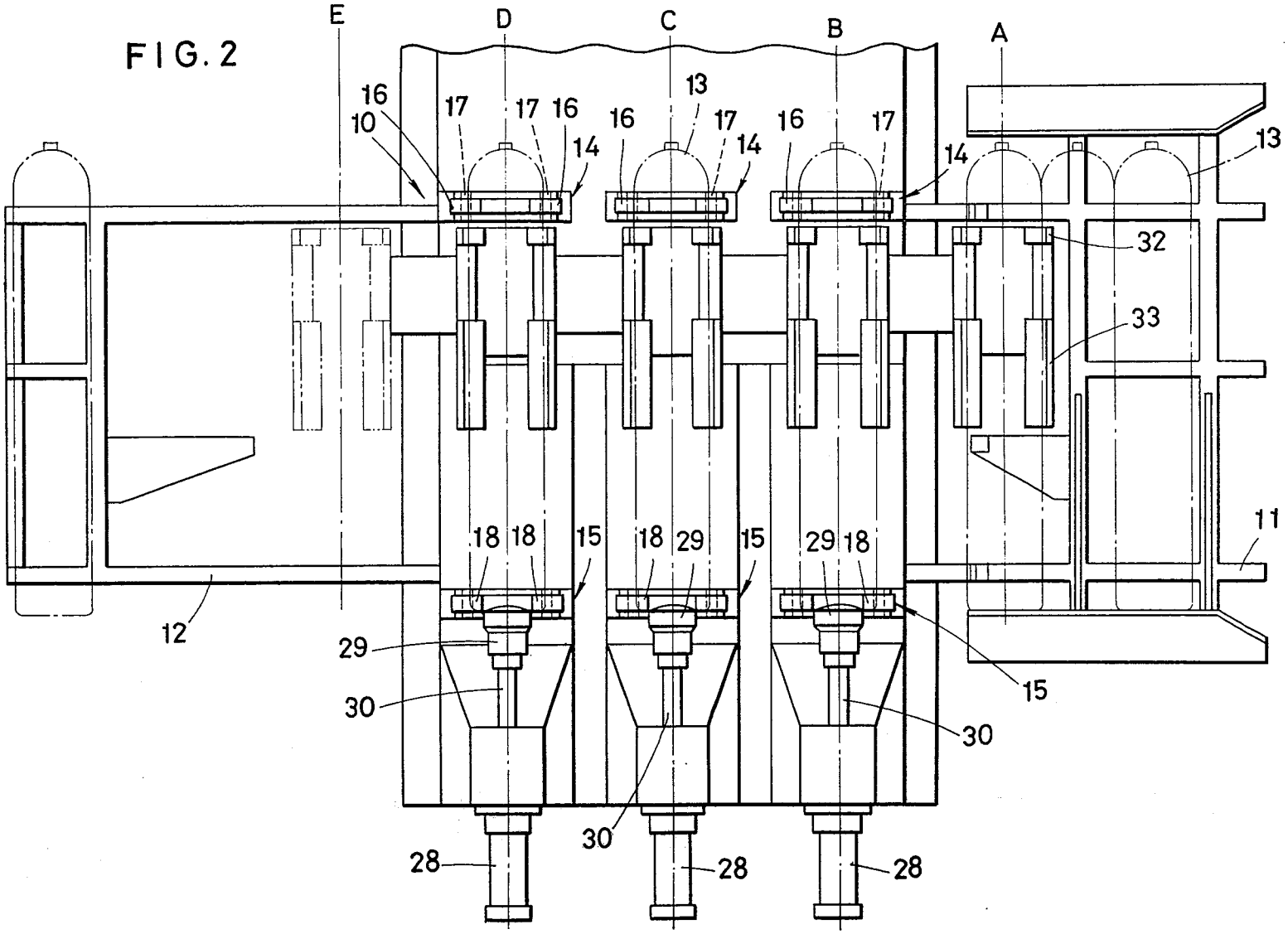
FIG. 2 is a top plan view of part of the apparatus shown in FIG. 1.
Figures 3, 4:
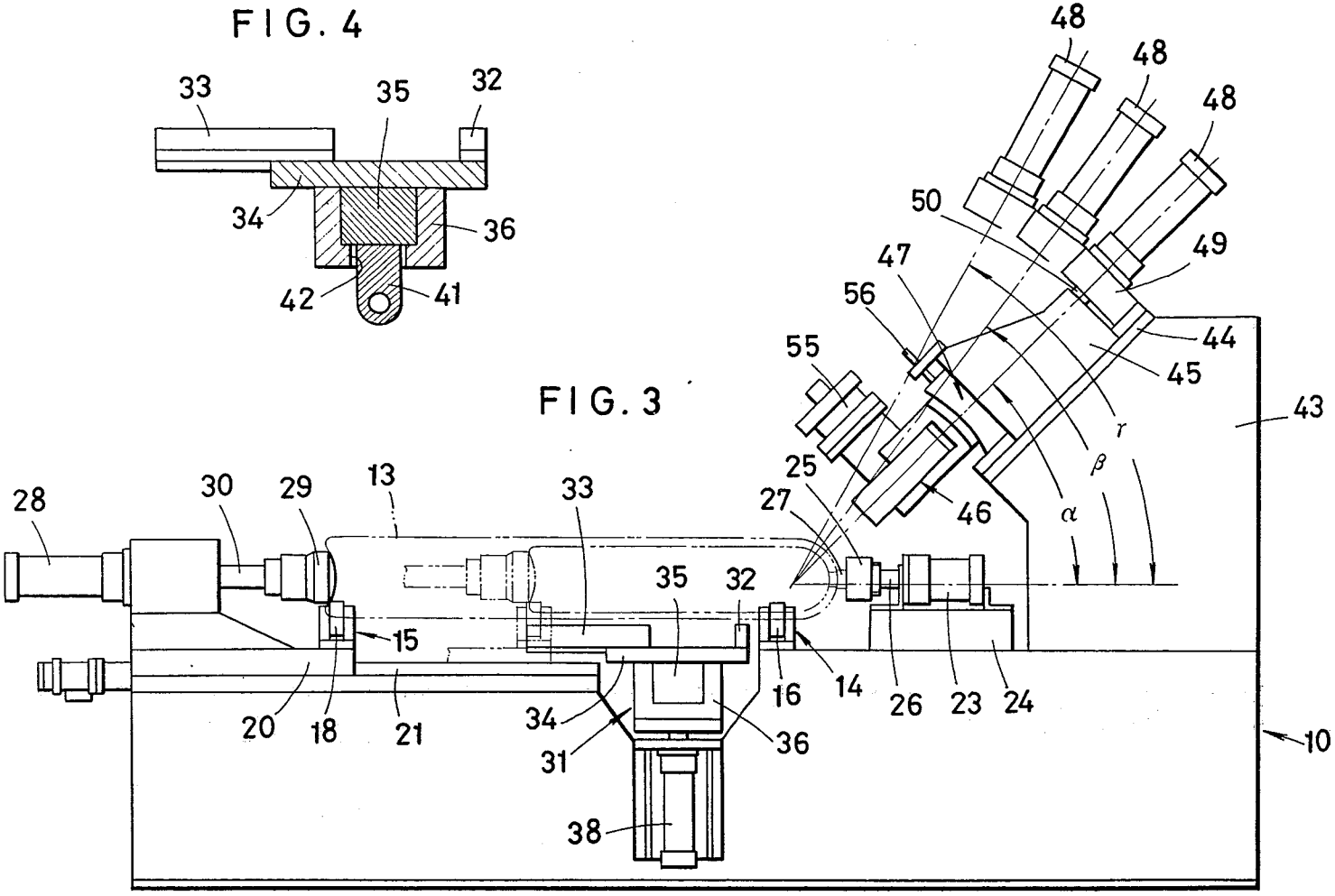
FIG. 3 is a vertical sectional view taken substantially along the line III—III of FIG. 1.
FIG. 4 is an enlarged, partical vertical sectional view taken along the line IV—IV of FIG. 1.

The invention will now be described more specifically as adapted, by way of example only, for an application where markings are to be formed in three parallel lines on the rounded head of each steel cylinder for a compressed gas (hereinafter referred to as a gas cylinder). With reference to FIGS. 1, 2 and 3, the numeral 10 generally denotes a frame or standard substantially integrally provided with a loading platform 11 at its rearward end, seen to the right in FIGS. 1 and 2, and an unloading platform 12 at its forward end. It will be observed from FIG. 1 that both loading and unloading platforms 11 and 12 decline forwardly and are disposed slightly higher than the general top plane of the frame 10.

The capitals A, B, C, D, and E in FIGS. 1 and 2 refer to the notional lines extending transversely of the frame 10 parallel to each other and at constant spacings. The line A is positioned at or adjacent the forward end of the loading platform 11 and will hereinafter be referred to as the loading line. The lines B, C and D are positioned between the loading and unloading platforms 11 and 12 and represent the positions where the desired markings are to be successively imprinted in three lines on each gas cylinder 13. The lines B, C and D will therefore be hereinafter referred to as the first, second and third marking lines, respectively. The line E is positioned at or adjacent the rearward end of the unloading platform 12 and will hereinafter be referred to as the unloading line.

In order to rotatably support the gas cylinder 13 in horizontal disposition and with its axis in register with each of the first, second and third marking lines B, C and D, a pair of transversely spaced work rests 14 and 15 are arranged on the frame 10 on each marking line. Each work rest 14 includes a pair of parallel spaced rolls 16 which are rotatably mounted on respective shafts 17 in bilateral symmetry with respect to the marking line and which preferably are equidistantly movable toward and away from the marking line to permit adjustment of the height of the article to be mounted thereon.

Each of the work rests 15 likewise includes a pair of parallel spaced rolls 18 rotatably mounted on respective shafts 19 in symmetrical positions with respect to the marking line. Each pair of rolls 18 should also be equidistantly movable toward and away from the marking line to permit adjustment of the article height. These work rests 15 are mounted on respective carriages 20, FIG. 3, that are slidable over guideways 21 toward and away from the corresponding work rests 14 to adjust to the axial length of each gas cylinder 13 to be mounted thereon. For thus moving the carriages 20 and therefore the work rests 15, a suitable actuator such as a hydraulic motor is provided at 22 for each carriage.

As best shown in FIG. 3, cylinder actuators 23 are fixedly supported on mounts 24 so as to be in axial alignment with the respective gas cylinders 13 on the marking lines B, C and D. A rotatable fitting 25 of suitable configuration is mounted on the end of the piston rod 26 of each cylinder actuator 23 for contact with the usual mouth 27 projecting from the head of each gas cylinder 13. These cylinder actuators 23 are thus adapted to rotatably hold the head of each gas cylinder during marking operation.

For rotatably holding the bottoms of the gas cylinders 13 on the marking lines B, C and D, cylinder actuators 28 are fixedly mounted on the aforesaid carriages 20, respectively, so as to be in axial alignment with the respective gas cylinders. A rotatable fitting 29 is mounted on the end of the piston rod 30 of each cylinder actuator 28 for contact with the bottom end of each gas cylinder 13. These cylinder actuators 28 are of course movable with the work rests 15 toward and away from the corresponding cylinder actuators 23 as dictated by the axial length of each gas cylinder to be marked.

The reference numeral 31 in FIGS. 1 and 3 generally designates a mechanism for transfer of the successive gas cylinders from the loading line A to the unloading line E through the successive marking lines B, C and D. The work transfer mechanism 31 comprises a pair of transversely spaced work rests 32 and 33 normally arranged in register with each of the loading, marking and unloading lines A, B, C, D and E. The work rests 32 and 33 are arranged internally of the first mentioned pairs of work rests 14 and 15 and have their top faces contoured in conformity with the cross sectional shape of each gas cylinder to permit the same to rest stably thereon.

The work transfer mechanism 31 further includes a carriage 34 extending longitudinally of the frame 10 and having all the pairs of work rests 32 and 33 fixedly mounted thereon. The carriage 34 has a rib 35 formed lengthwise on its bottom surface. This rib is slidably received in a guide 36 of U-shaped cross section which is secured to the piston rods 37 of a pair of cylinder actuators 38 arranged uprightly under the guide at or adjacent the opposite ends thereof.

The cylinder actuators 38 are intended to cause the up-and-down motion of the guide 36 and, therefore, of all the work rests 32 and 33 on the carriage 34. The piston stroke of the cylinder actuators 38 should be such that, at the upper extremity of the work rests 32 and 33, the lower ends of the gas cylinders supported thereon will be slightly higher than the tops of the rolls 16 and 18, whereas at the lower extremity of the work rests 32 and 33, these work rests will be out of contact with the gas cylinders as the same rest on the rolls 16 and 18.

Another cylinder actuator 39 is securely bracketed to the underside of the guide 36 in horizontal disposition. The piston rod 40 of this cylinder actuator is coupled to a tongue 41 projecting downwardly from the rib 35 of the carriage 34 to cause the back-and-forth motion of the carriage in the longitudinal direction of the frame 10 relative to the guide 36.

As best shown in FIG. 4, the tongue 41 extends through a slot 42 formed lengthwise in the bottom of the guide 36. The length of this slot 42 is approximately equal to the piston stroke of the cylinder actuator 39 which, in turn, is equal to the distance between the lines A, B, C, D and E. Thus, in the operation of this apparatus, the carriage 34 will cyclically move upwardly, leftwardly as seen in FIGS. 1 and 2, downwardly, and then rightwardly back to its initial position, as will be later described in more detail.

Figure 5:
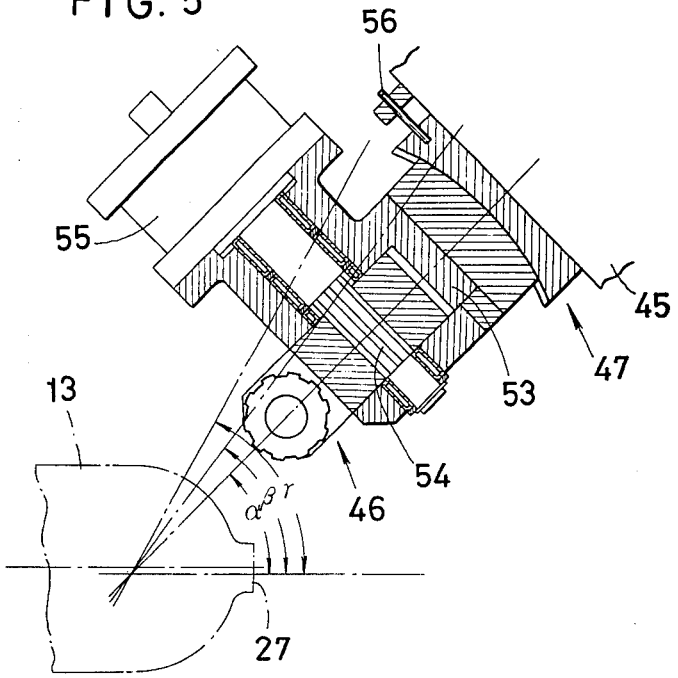
FIG. 5 is an enlarged, axial sectional view of one of the marking mechanisms shown in FIG. 3, the view being also explanatory of the positional relationship between the marking mechanism and the work to be marked.

As will be seen from a consideration of FIGS. 3 and 5, a standard 43 is formed on the frame 10 on one side of the path of travel of the work through the successive marking lines B, C and D. The standard 43 has formed thereon a sloping guideway 44 at an angle of $\alpha$ degrees with respect to the plane of the horizon. This particular sloping guideway is arranged on the extension of the first marking line B, and there is slidably mounted thereon a carriage 45 having a marking mechanism 46 attached thereto via an angle adjustment mechanism 47. A cylinder actuator 48 fixedly supported on a mount 49 on the standard 43 has its piston rod 50 coupled to the carriage 45 to cause the reciprocating motion of the marking mechanism 46 toward and away from the substantially hemispherical head of the gas cylinder 13 on the first marking line B.

Figure 6:
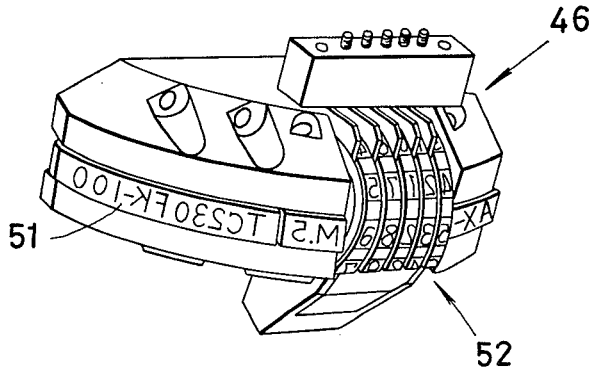
FIG. 6 is a perspective view of the marking mechanism shown in FIG. 5.

It will be observed from FIG. 6 that the marking mechanism 46 includes an arcuate marking surface 51 having formed thereon a line of suitable indicia in relief. This marking surface is intended to make rolling contact with the head of each gas cylinder 13 at its predetermined point and hence to imprint the indicia thereon. It should be noted that the marking mechanism 46 is moved back and forth by the cylinder actuator 48 in a direction perpendicular to the plane tangent to the gas cylinder 13 on the first marking line B at its predetermined point of contact with the marking surface 51. This direction, of course, is at the angle of $\alpha$ degrees with the plane of the horizon.

The marking mechanism 46 may include a conventional numbering mechanism 52 so that consecutive numbers may be marked on the successive gas cylinders along with the other necessary indicia. The marking mechanism 46 is supported by its holder 53 so as to be rotatable relative to the latter about a shaft 54 arranged parallel to the aforesaid plane tangent to the gas cylinder 13 at its point of contact with the marking surface 51. A conventional rotary cylinder actuator 55 is mounted on the holder 53 to impart rotation to the shaft 54 and hence to the marking mechanism 46. The angular position of this marking mechanism, inclusive of its holder 53, with respect to the plane of the horizon is manually adjustable as required by an adjusting screw 56 constituting a part of the angle adjusting mechanism 47.

Although not fully illustrated, two other guideways similar to the illustrated guideway 44 are formed on the standard 43 on the extensions of the second and third marking lines C and D, respectively, as will be evident from FIG. 3. Mounted on each of the unshown guideways are parts or components corresponding to the above described carriage 45, marking mechanism 46, angle adjustment mechanism 47, cylinder actuator 48, rotary cylinder actuator 55 and so forth. These additional guideways are arranged at angles of $\beta$ and $\gamma$ degrees with the plane of the horizon so that the marking mechanisms mounted thereon may respectively travel back and forth in directions perpendicular to the planes tangent to the gas cylinders 13 on the second and third marking lines C and D at their predetermined points of contact with the marking surfaces of the additional marking mechanisms. These marking mechanisms associated with the second and third marking lines C and D are thus adapted to imprint two additional lines of indicia on the head of each gas cylinder as the same is carried to the second and third marking lines by the work transfer mechanism 31.

The reference numeral 57 in FIG. 1 denotes stop means formed at the forward end of the loading platform 11 for holding the successive gas cylinders 13 on the loading line A. Similar stop means 58 is formed at the forward end of the unloading platform 12 for holding thereon the gas cylinders which have been marked.

Preparatory to the actual marking operation the various operating parts of the above described apparatus should be adjusted in accordance with the size of the gas cylinders to be marked. To this end the hydraulic motors 22 may be actuated to move the carriages 20 to a suitable position on the guideways 21 in accordance with the length of each gas cylinder. The positions of the work rests 15 and cylinder actuators 28 are thus variable within limits in the transverse direction of the frame 10 to adjust to the length of each gas cylinder, as will be understood from a consideration of FIG. 3.

The spacing between the pairs of rolls 16 or 18 of each of the work rests 14 and 15 should also be adjusted so that the axis of the gas cylinder mounted thereon will align with the axes of each cylinder actuator 23 and the corresponding cylinder actuator 28. It is also necessary to adjust the piston stroke of each cylinder actuator 23 for holding each gas cylinder in a desired position with respect to the transverse direction of the frame 10. The piston stroke of each cylinder actuator 28 should also be correspondingly adjusted so that each gas cylinder will be rotatably supported between the fittings 25 and 29 of the cylinder actuators 23 and 28 upon extension of their piston rods 26 and 30.

Furthermore, the angular positions of the three marking mechanisms 46 may be adjusted, if necessary, by the respective angle adjustment mechanisms 47 so that the arcuate marking surfaces 51 of the marking mechanisms will exactly make close rolling contact with desired portions of the gas cylinders 13 on the first, second and third marking lines B, C and D, respectively. The piston strokes of the cylinder actuators 48 should be such that the surfaces 51 of the marking mechanisms 46 will be forced against the respective gas cylinders to a sufficient degree to imprint the indicia thereon.

Following these adjusting operations the piston rods 26, 30 and 50 of the cylinder actuators 23, 28 and 48 should be retracted into the respective cylinders. The piston rods 37 and 40 of the cylinder actuators 38 and 39 should also be retracted to bring the carriage 34 of the work transfer mechanism 31 to the position indicated by the dashed lines in FIG. 1. If all the actuators used in this apparatus are of hydraulic type, then a suitable source of hydraulic pressure (not shown) may be switched on to make the various actuators ready for operation at desired working pressures.

Gas cylinders 13 to be marked may now be deposited transversely on the loading platform 11 at the rearward end of the frame 10, with their mouths 27 directed away from the viewer as seen in FIG. 1. The gas cylinders will roll over the sloping platform 11 until the leading cylinder stops upon contact with the stop means 57, with the result that several gas cylinders are held at a temporary standstill on the loading platform in side-by-side relationship. The leading gas cylinder has now its axis in register with the loading line A.

The pair of upright cylinder actuators 38 of the work transfer mechanism 31 may then be set in operation to raise the carriage 34 and hence the leading gas cylinder 13 resting on the pair of work rests 32 and 33 on the loading line A. The horizontal cylinder actuator 39 is then caused to operate to move the carriage 34 forwardly a distance equal to the spacing between the lines A to B, so that the leading gas cylinder is carried over the pair of work rests 14 and 15 on the first marking line B. By then causing reaction of the piston rods 37 of the upright cylinder actuators 38, the leading gas cylinder will be deposited upon the pair of work rests 14 and 15, with its axis in register with the first marking line. The carriage 34 is succeedingly moved back to the initial position by the cylinder actuator 36.

All the cylinder actuators 23 and 28 may then be activated to cause extension of their piston rods 26 and 30, with the result that the leading gas cylinder is caught between the rotatable fittings 25 and 29 of the opposed pair of cylinder actuators on the first marking line B. The gas cylinder is now rotatably held in position on the first marking line against any possibility of displacement during the subsequent marking operation.

The three cylinder actuators 48 on the standard 43 may then be caused simultaneously to operate to move the carriage 45 and therefore the marking mechanisms 46 downwardly over the respective guideways 44. The marking surface 51 of the marking mechanism on the first marking line B is thus forced into pressure contact with the head of the leading gas cylinder. As the rotary actuators 55 are succeedingly set in operation, the marking mechanism will rotate with its surface 51 in rolling contact with the gas cylinder.

With the desired indicia thus imprinted in a single line on the head of the gas cylinder 13 on the first marking line B, the cylinder actuators 48 and rotary actuators 55 will operate to bring the marking mechanisms 46 back to their initial standby positions. The piston rods 26 and 30 of the cylinder actuators 23 and 28 are then also caused to retract to their initial standby positions, thereby releasing the leading gas cylinder on the work rests 14 and 15 on the first marking line B.

By the repetition of the foregoing procedure, the leading gas cylinder 13 will be succeedingly transferred to the second marking line C, where a second line of indicia is to be marked on the gas cylinder. While the second line of indicia is thus being imprinted on the leading gas cylinder, the first line of indicia is simultaneously imprinted on the next gas cylinder on the first marking line B. In this manner the three lines of indicia are simultaneously imprinted upon the respective gas cylinders on the first, second and third marking lines B, C and D. The gas cylinders that have undergone the three steps of marking operation are successively carried onto the loading platform 12 by the work transfer mechanism 31.

While the various objects of this invention, either expressly stated or otherwise, are believed to have been fully accomplished in the preferred form of the marking apparatus shown and described hereinbefore, it is also understood that the invention itself is not to be restricted by the exact showing of the drawings or the description thereof, as many modifications will readily occur to the specialists on the basis of this disclosure. It is therefore appropriate that the invention be construed broadly and in a manner consistent with the spirit and scope of the following claims.

What is claimed is:

1. An apparatus for engraving markings in a plurality of lines on each of metal cylinder articles for compressed gases, comprising in combination:

a frame having a rearward end and a forward end, said frame having notional lines extending in its transverse direction at constant spacings, said notional lines consisting of a loading line adjacent said rearward end of said frame and comprising a loading platform, an unloading line adjacent said forward end of said frame and comprising an unloading platform, and a plurality of marking lines between said loading and unloading lines;

work rest means comprising spaced rollers arranged at said marking lines on said frame, said articles each having a longitudinal axis, said spaced rollers receiving successive articles with said longitudinal axes of said articles being horizontally disposed, said articles received on said spaced rollers being rotatable about their longitudinal axes;

work transfer means for conveying the successive articles from said loading line to said unloading line through the successive marking lines, said work transfer means comprising a guide means, a carriage slidably mounted on said guide means, work rest elements extending from said guide means, first cylinder-piston means for raising and lowering said guide means between raised and lowered positions such that in said raised position said work rest elements engage said articles to raise the latter from said resting position on said spaced rollers and in said lowered position said work rest elements are disposed at an elevation lower than said articles such that the latter are free to be received on said spaced rollers, and second cylinder-piston means for sliding said carriage relative to said guide means between advanced and retracted positions, said second cylinder-piston means sliding said carriage from said retracted position to said advanced position when said guide means is in said raised position, said second cylinder-piston means sliding said carriage from said advanced to said retracted position when said guide means is in said lowered position;

work holding means for releasably holding the articles on said spaced rollers against longitudinal displacement while permitting the same to rotate about their own longitudinal axes;

marking means arranged over said frame in register with each of said marking lines, said marking means including an arcuate marking surface which has formed thereon a line of indicia to be engraved on the article at each said marking line;

means for moving said marking means back and forth to bring said marking surface into and out of pressure contact with the article rotatably held on each said marking line, said marking means being thus moved in a direction perpendicular to a plane tangent to the article on said marking line at a different point of contact with said marking surface; and means for rotating said marking surface in rolling contact with the article on each said marking line to engrave the line of indicia thereon, said artical being rotated about its longitudinal axis by said rotating surface;

whereby a plurality of lines of indicia are engraved on each article as the same travels through the successive marking lines.

2. An apparatus according to claim 1 wherein said work holding means comprises power operated cylinder-piston means disposed at the longitudinal ends of said articles and operable to engage the longitudinal ends of said articles, said power operated cylinder-piston means having their longitudinal axes coextensive with the longitudinal axes of said articles when the latter are received on said work rest means.

3. An apparatus according to claim 1 wherein said guide means extends longitudinally to underlie said loading platform and said work rest means when said second cylinder-piston means is in said retracted position and to underlie said unloading platform and said work rest means when said second cylinder-piston means is in said advanced position.

4. An apparatus according to claim 1 wherein said second cylinder-piston means comprises a piston rod extending from a cylinder, said cylinder being fixedly mounted on said guide means, said piston rod being secured to said carriage for sliding the latter relative to said guide means.

5. An apparatus according to claim 1 wherein said work rest elements comprise pairs of work rest parts which are spaced from each other in the transverse direction of said frame.

* * * * *